United States Patent [19]

Guerr

[11] 3,954,279

[45] May 4, 1976

[54] RESILIENT SKATE BOARD

[76] Inventor: Herbert Guerr, 2128 W. 233rd St., Torrance, Calif. 90501

[22] Filed: May 5, 1975

[21] Appl. No.: 574,318

[52] U.S. Cl. ..... 280/87.04 A; 272/70; 280/11.19

[51] Int. Cl.[2] ..... A63C 17/00

[58] Field of Search ..... 280/87.04 A, 11.1 R, 280/11.1 BT, 11.14, 11.28, 11.23, 11.19, 11.27, 106.5 R; 267/89, 69, 70, 71, 160; 272/57 B, 70

[56] References Cited

UNITED STATES PATENTS

| | | | |
|---|---|---|---|
| 3,023,022 | 2/1962 | Boyden | 280/87.04 A |
| 3,153,543 | 10/1964 | Magyar | 280/87.04 A |
| 3,311,365 | 3/1967 | Eckel | 267/89 |
| 3,795,409 | 3/1974 | Cudmore | 280/87.04 A |

*Primary Examiner*—Philip Goodman
*Assistant Examiner*—David M. Mitchell
*Attorney, Agent, or Firm*—Theodore H. Lassagne

[57] ABSTRACT

A skate board comprising an elongate body having roller trucks adjacent its ends is moulded of thin flexible plastic and reinforced by an adjustable shock absorber attached to the underside of the body between the roller trucks.

1 Claim, 5 Drawing Figures

RESILIENT SKATE BOARD

BACKGROUND OF THE INVENTION

1. Field of the Invention

The present invention relates to improvements in skate boards which are, essentially, wheel vehicles comprising an elongate body portion having roller skate type roller trucks mounted adjacent each end.

2. The Prior Art

For many years young people have fabricated skate boards from pieces of scrap lumber and old roller skates by separating the roller trucks of the skates and mounting them adjacent the opposite ends of an elongate piece of scrap lumber usually about two feed long and four or five inches wide. The user usually supports one foot on the body of the device while propelling it with the other foot, but may place both feet on the device and balance his body while coasting. Steering may be effected to a limited degree by shifting body weight in such a way as to tilt the board to one side or the other.

It is the primary object of the present invention to provide a skate board having a greater degree of flexibility than has heretofore been achieved, thus enhancing the maneuverability of the board and providing a cushioning effect.

SUMMARY OF THE INVENTION

According to the present invention a skate board is provided which comprises an elongate body portion which presents a planar upper surface to provide a foot rest for the user, the body portion being provided with roller skate type roller trucks secured to its underside adjacent opposite ends thereof. The body portion is preferably moulded of plastic and is of such thinness and flexibility as to be incapable, without reinforcement, of supporting the weight of a human body between the roller trucks.

A resilient body-portion-reinforcing and shock absorbing assembly is attached to the underside of the body portion between the roller trucks. This assembly comprises basically a pair of angle brackets secured to the underside of the body portion, one adjacent each of the roller trucks, and a metal rod connecting the brackets which extends between them parallel to the body portion and spaced therefrom so that it may act as a limit stop for deformation of the plastic body portion by the weight of the user. It may also be made resilient, though less so than the body portion, to provide a secondary cushioning effect.

In the preferred embodiment of the invention the metal rod passes through an aperture in one of the angle brackets, and a spring is compressed between the apertured bracket and the end of the rod extending through the aperture. Means are provided for adjustably varying the initial compression of the spring, comprising a nut threaded on the end of the rod.

DESCRIPTION OF THE PREFERRED EMBODIMENT

Figure 5:
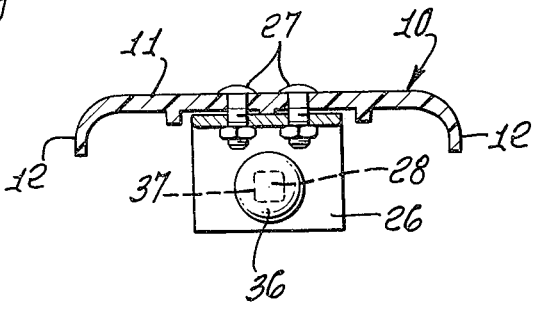
FIG. 5 is a detail view taken on the line 5—5 of FIG. 2.

As shown in the drawing, the skate board of the present invention comprises an elongate body portion 10 presenting a planar upper surface 11 (FIGS. 1 and 3) providing a rest for the foot of the user. The body portion 10 is preferably moulded of a flexible plastic material and provided with a depending edge portion 12 (see also FIG. 5) which both enhances the appearance of the device and imparts a degree of strength to the body portion 10 permitting it to be moulded in a thinner section than would otherwise be the case.

Secured to the underside of the body portion 10 by means such as bolts 13 are roller trucks 15. Each of the roller trucks is of a type commonly used in conventional roller skates and comprises a pair of rollers 16 rotatably mounted on an axle 17 supported by an arm 18 and a conventional cushioning assembly 19 connected to a base plate 20 which in turn is secured to the body portion 10 by bolts 13.

Figure 3:
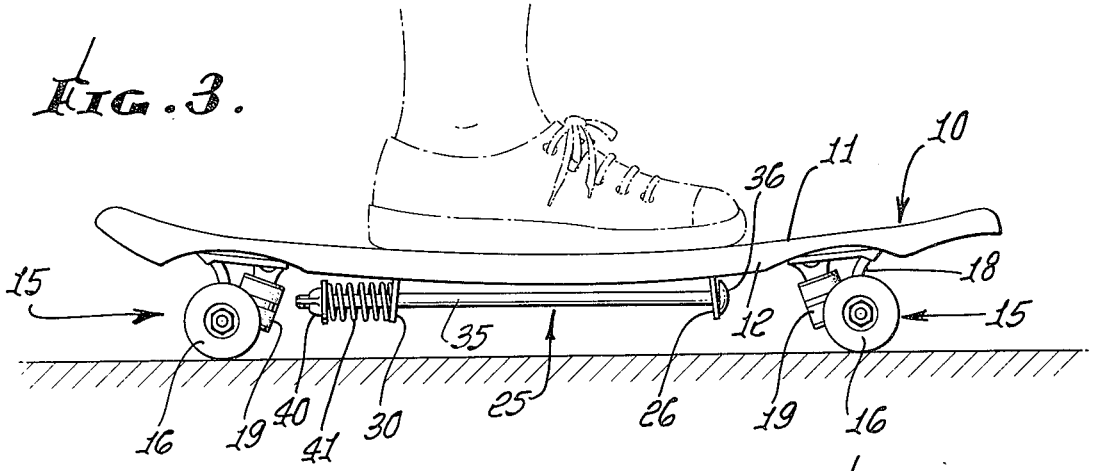
FIG. 3 is a view in side elevation of the skate board of FIG. 1 illustrating the manner in which the parts are repositioned by the weight of a user.

The body portion 10 is of such thinness and flexibility as to be incapable, without reinforcement, of supporting the weight of a human body imposed between the roller trucks 15 as shown in FIG. 3. According to the present invention, therefore, a resilient body-portion-reinforcing and shock absorbing assembly 25 is secured to the underside of the body portion 10, so positioned between the roller trucks 15 as to reinforce that part of the body portion 10 lying between them.

Each such assembly 25 comprises a forward angle bracket 26 secured to the body portion 10 as by nut and bolt assemblies 27 (FIG. 5) and provided with a non-circular aperture 28. Also included in each such assembly is a rear angle bracket 30 (see also FIG. 4) secured to the body portion 10 by means such as nut and bolt assemblies 31 and provided with an aperture 32.

Figure 4:
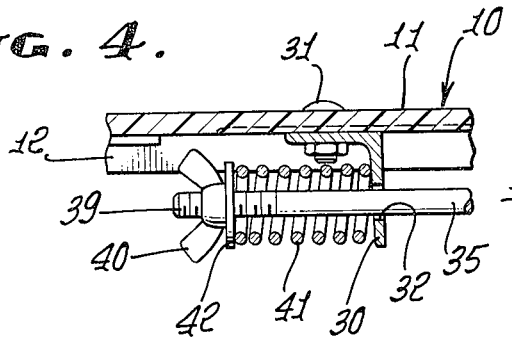
FIG. 4 is a detail view taken on the line 4—4 of FIG. 2.

Included in the assembly 25 is a metal rod 35 provided with a head 36 and a non-circular portion 37 adjacent the head 36 which fits within the non-circular aperture 28 of the angle bracket 26 so as to prevent rotation of the rod 35 with respect to the bracket 26. As best shown in FIG. 4, the end of the rod 35 opposite the head 36 passes through the aperture 32 in the angle bracket 30 and is provided at its end with a threaded portion 39 upon which a wing nut 40 is threaded. A spiral spring 41 is compressed between the angle bracket 30 and a washer 42 encircling the rod 35 adjacent the wing nut 40.

Figure 1:
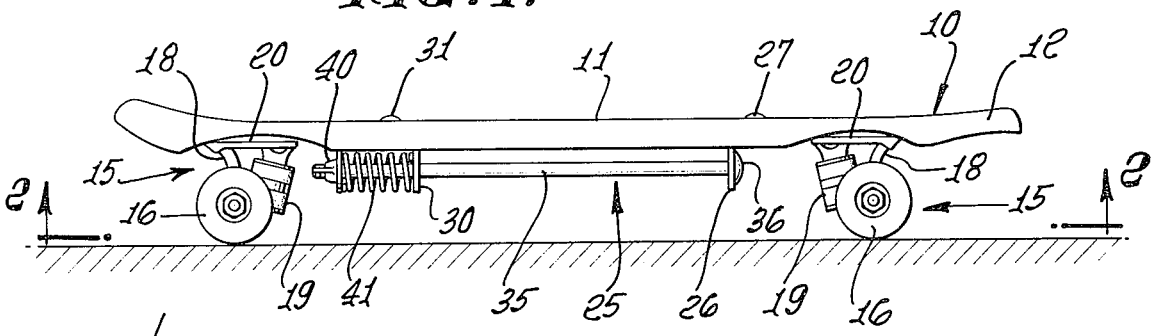
FIG. 1 is a view in side elevation of a skate board embodying the present invention.
Figure 2:
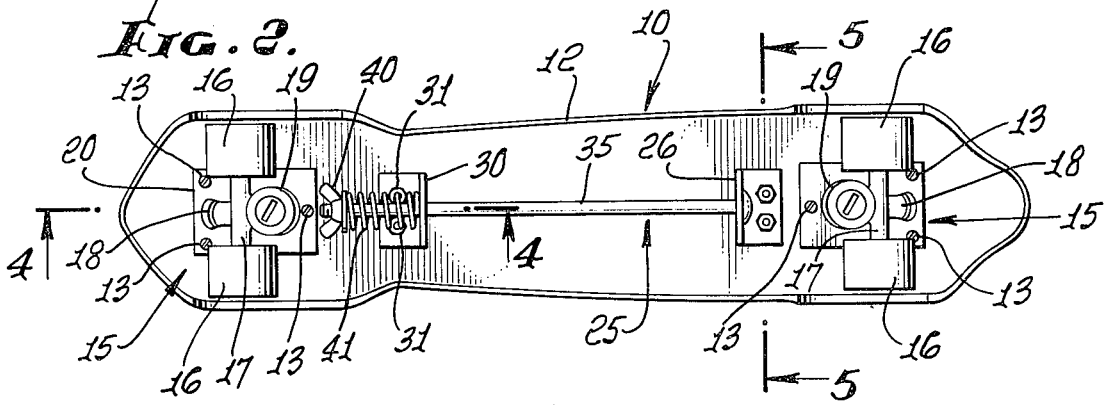
FIG. 2 is a plan view of the underside of the skate board of FIG. 1 as viewed from the line 2—2 of FIG. 1.

In operation, when the foot of a user of the device is placed on the surface 11 in the position shown in FIG. 3 and the weight of the user's body is imposed upon it, the body portion 10 is bent from the position in which it is shown in FIG. 1 approximately to the position in which it is shown in FIG. 3 depending upon the user's weight. This causes the free ends of the angle brackets 26 and 30 to move slightly apart from each other, compressing the spring 41 until a balance of forces is achieved. The initial compression of the spring 41 may be increased or decreased by rotation of the nut 40 on the threaded portion 39 of the rod 35, and in any event the rod 35 acts as a limiting stop for the central portion of the body portion 10, inhibiting depression of that portion beyond the position occupied by the rod 35 parallel to and spaced from the body portion 10. If desired, the rod 35 may be made resilient to any desired degree to provide alternative or additional cushioning for the body portion 10 should the central portion of the latter be depressed into contact with the rod 35 by an unusually heavy user.

I claim:

1. In a skate board an elastic, elongate body portion presenting a planar upper surface providing a foot rest, a pair of roller trucks secured to the underside of said body portion adjacent opposite ends thereof; said body portion being of such thinness and flexibility as to be incapable of supporting the weight of a human body between said roller trucks, and a resilient body-portion-reinforcing and shock absorbing assembly attached to said body portion comprising a pair of angle brackets secured to the underside of said body portion, one adjacent each of said roller trucks; one of said angle brackets having an aperture, a metal rod having an end extending through said aperture and extending between said brackets parallel to said body portion and spaced therefrom, a spring compressed between said apertured bracket and the end of said rod extending through said aperture, and means for adjustably varying the initial compression of said spring comprising a nut threaded on the end of said rod extending through said aperture.

* * * * *